US007207624B2

(12) United States Patent
Hoffman et al.

(10) Patent No.: US 7,207,624 B2
(45) Date of Patent: Apr. 24, 2007

(54) OTTOMAN CONVERTIBLE TO SEATING UNIT

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 11/453,501

(22) Filed: Jun. 15, 2006

(65) Prior Publication Data

US 2006/0284451 A1 Dec. 21, 2006

Related U.S. Application Data

(60) Provisional application No. 60/692,023, filed on Jun. 17, 2005.

(51) Int. Cl.
*A47C 13/00* (2006.01)

(52) U.S. Cl. ..... 297/125; 297/17; 297/118

(58) Field of Classification Search ..... 297/17, 297/118, 124, 125, 188.1
See application file for complete search history.

(56) References Cited

U.S. PATENT DOCUMENTS

| | | | |
|---|---|---|---|
| 213,512 | A | 3/1879 | Landis |
| 577,138 | A | 2/1897 | Hubbard |
| 640,647 | A | 1/1900 | Gannett |
| 1,018,593 | A | 2/1912 | Swanson |
| 1,509,863 | A | 9/1924 | Erickson |
| D151,983 | S | 12/1948 | Guertin |
| D151,984 | S | 12/1948 | Guertin |
| D160,390 | S | 10/1950 | Hubbert |
| 2,577,741 | A | 12/1951 | Creveling et al. |
| 2,579,577 | A | 12/1951 | Hill |
| 2,582,703 | A | 1/1952 | Kirshbaum |
| 2,625,204 | A | 1/1953 | Reichman |
| 2,635,678 | A | 4/1953 | Basil |
| 2,696,870 | A | 12/1954 | Mende |
| 2,804,122 | A | 8/1957 | Baum |
| 2,812,227 | A | 11/1957 | Hill |
| 2,838,097 | A | 6/1958 | Gleitsman et al. |
| 2,877,830 | A | 3/1959 | Smith |
| 2,950,753 | A | 8/1960 | Gleitsman et al. |

(Continued)

FOREIGN PATENT DOCUMENTS

| | | |
|---|---|---|
| CH | 195920 | 5/1938 |

(Continued)

*Primary Examiner*—Peter R. Brown
(74) *Attorney, Agent, or Firm*—Myers Bigel Sibley & Sajovec

(57) ABSTRACT

An ottoman convertible to a seating unit includes: a body; a seat associated with the body; and a lid pivotally attached to the body, the lid having an underside. The lid is movable between a closed position, in which the lid overlies the body, the seat is beneath the lid, and the underside of the lid faces generally downwardly, and an open position, in which the lid is generally upright and located above a rear portion of the body, the underside of the lid faces generally forwardly and forms the backrest of a seating unit and the seat is accessible for a seated occupant. The seat is inclined from rear to front. Typically, movement of the lid and the seat (if any) is controlled by one or more mechanisms that couple the seat and the lid.

22 Claims, 4 Drawing Sheets

U.S. PATENT DOCUMENTS

| | | | | |
|---|---|---|---|---|
| 2,981,313 | A * | 4/1961 | Odell | 297/135 |
| 3,114,574 | A | 12/1963 | Pryale | |
| 3,145,049 | A | 8/1964 | Duke | |
| 3,227,112 | A | 1/1966 | Wiseman | |
| 3,451,718 | A | 6/1969 | Kaufman | |
| 3,942,835 | A | 3/1976 | Harrison | |
| 4,083,599 | A | 4/1978 | Gaffney | |
| 4,557,080 | A | 12/1985 | Walworth et al. | |
| 4,577,902 | A | 3/1986 | Crum | |
| 4,669,778 | A | 6/1987 | Rogers, Jr. | |
| 4,834,449 | A | 5/1989 | Engelman | |
| 4,946,222 | A | 8/1990 | Matson | |
| 5,087,094 | A | 2/1992 | Rogers, Jr. | |
| 5,098,153 | A * | 3/1992 | Antoine | 297/17 |
| 5,160,183 | A | 11/1992 | Rusyniak | |
| 5,186,518 | A | 2/1993 | Pine | |
| 5,466,041 | A | 11/1995 | Hoffman | |
| 6,698,830 | B1 * | 3/2004 | Gaines | 297/188.11 |
| 2005/0023869 | A1 * | 2/2005 | Longnecker | 297/125 |

FOREIGN PATENT DOCUMENTS

| | | |
|---|---|---|
| DE | 814708 | 7/1949 |
| GB | 0002601 | 0/1900 |
| GB | 0240085 | 9/1925 |

* cited by examiner

OTTOMAN CONVERTIBLE TO SEATING UNIT

RELATED APPLICATION

This application claims priority from U.S. Provisional Patent Application No. 60/692,023, filed Jun. 17, 2005, the disclosure of which is hereby incorporated herein in its entirety.

FIELD OF THE INVENTION

The present invention relates generally to furniture, and more particularly to seating units and ottomans.

BACKGROUND OF THE INVENTION

Quite often a seating unit within a home will be accompanied by a footstool, such as an ottoman or hassock. Footstools are, of course, generally placed in front of the seating unit and thereby provide a surface upon which occupants of the seating unit can rest their feet.

Footstools can additionally serve as storage receptacles for articles such as books, magazines, cards and games, writing instruments, sewing materials, beverages, and the like. See e.g., U.S. Pat. No. 2,812,227 to Hill; U.S. Pat. No. D160,390 to Hubbert. The typical storing ottoman has a removable top that, upon removal, exposes a storage receptacle within the vertical walls of the ottoman. The cover may be completely detachable or may be pivotally interconnected to the top of one of the vertical walls. See Hubbert, supra. Of these, the pivotally interconnected cover is generally preferred for the convenience it affords. The pivotal interconnection of the cover to the base precludes the need to the operator to locate an appropriate spot to store the cover when it is removed or to search for the cover when it is to be replaced. An ottoman disclosed in U.S. Pat. No. 5,466,041 to Hoffman includes a mechanism that controls the movement of the cover of the ottoman such that the cover is positioned behind and below the upper edge of the vertical walls of the ottoman to provide stability.

Generally speaking, ottomans are used to support the feet of the occupant of a nearby chair; nevertheless, on some occasions an ottoman may be used to support a seated occupant. The use of an ottoman by a seated occupant is particularly prevalent when the ottoman includes castors that enable it to be rolled to other parts of the room. However, sitting on an ottoman for an extended period of time may be uncomfortable for some occupants, as an ottoman lack the backrest included in a typical seating unit such as a chair or sofa.

SUMMARY OF THE INVENTION

As a first aspect, embodiments of the present invention are directed to an ottoman convertible to a seating unit. The ottoman comprises: a body; a seat associated with the body; and a lid pivotally attached to the body, the lid having an underside. The lid is movable between a closed position, in which the lid overlies the body, the seat is beneath the lid, and the underside of the lid faces generally downwardly, and an open position, in which the lid is generally upright and located above a rear portion of the body, the underside of the lid faces generally forwardly and forms the backrest of a seating unit and the seat is accessible for a seated occupant. The seat is inclined from rear to front. Typically, movement of the lid and the seat (if any) is controlled by one or more mechanisms that couple the seat and the lid.

As a second aspect, embodiments of the present invention are directed to an ottoman convertible to a seating unit that comprises: a body; a seat; a mechanism comprising a plurality of pivotally interconnected members, the mechanism coupling the seat with the body; and a lid pivotally attached to the body, the lid having an underside. The lid is movable between a closed position, in which the lid overlies the body, the seat is beneath the lid, and the underside of the lid faces generally downwardly, and an open position, in which the lid is generally upright and located above a rear portion of the body, the underside of the lid faces generally forwardly and forms the backrest of a seating unit and the seat is accessible for a seated occupant. The mechanism is configured such that the seat can move between a lowered position and a raised position in which sitting is comfortable.

DETAILED DESCRIPTION OF EMBODIMENTS OF THE INVENTION

Figure 1:
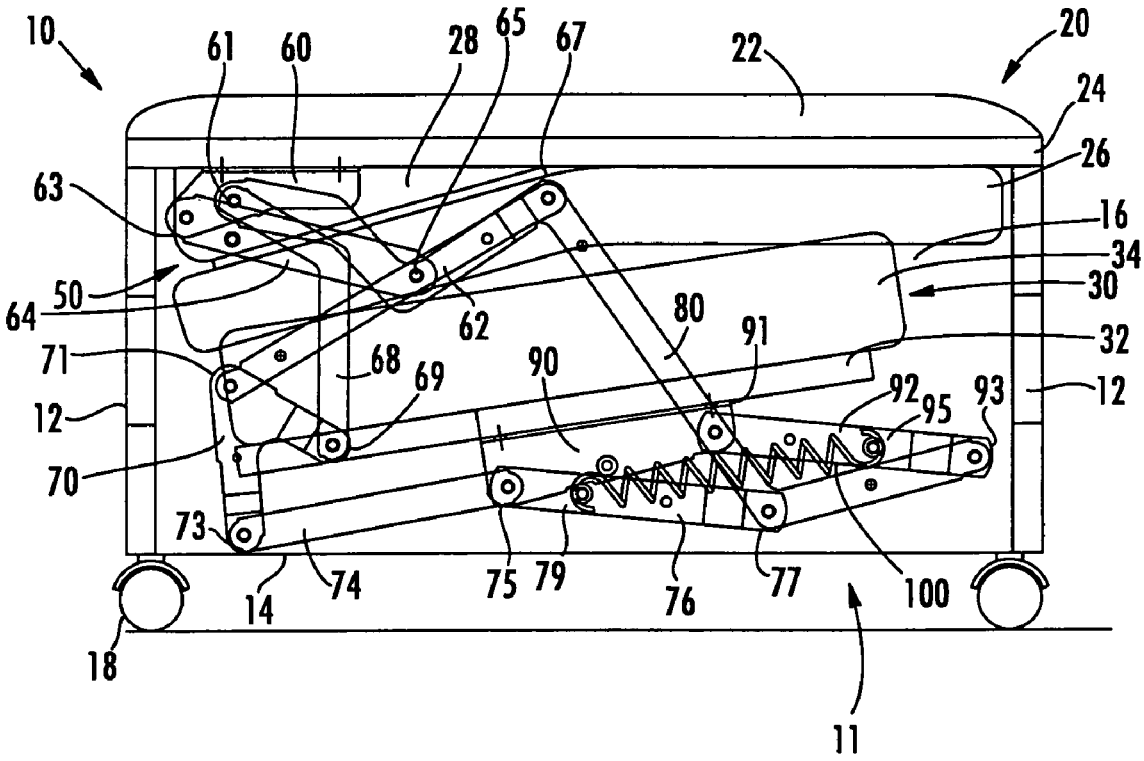
FIG. 1 is a side view of an ottoman according to embodiments of the present invention, wherein the ottoman is in its closed position.

The present invention will be described hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly. indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

This invention is directed to ottomans that are convertible into seating units that have a seat and a backrest. As used herein, the terms "forward", "forwardly", and "front" and derivatives thereof refer to the direction defined by a vector extending from the backrest, when the ottoman is in its open position, toward the seat, parallel to the underlying surface. Conversely, the terms "rearward", "rearwardly", and derivatives thereof refer to the direction directly opposite the forward direction; the rearward direction is defined by a vector that extends from the seat, when the ottoman is in the open position, toward the backrest, parallel to the underlying surface. The terms "up", "upwardly", and derivatives thereof refer to the direction defined by a vector extending from the underlying surface toward the top of the backrest, when the ottoman is in the open position. Conversely, the terms "down", "downwardly", and derivatives thereof refer to the direction directly opposite the upward direction.

The ottomans illustrated and described herein comprise a plurality of pivotally interconnected linkages and brackets. Those skilled in this art will appreciate that the pivot points between linkages can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4–21 (1979).

Figure 2:
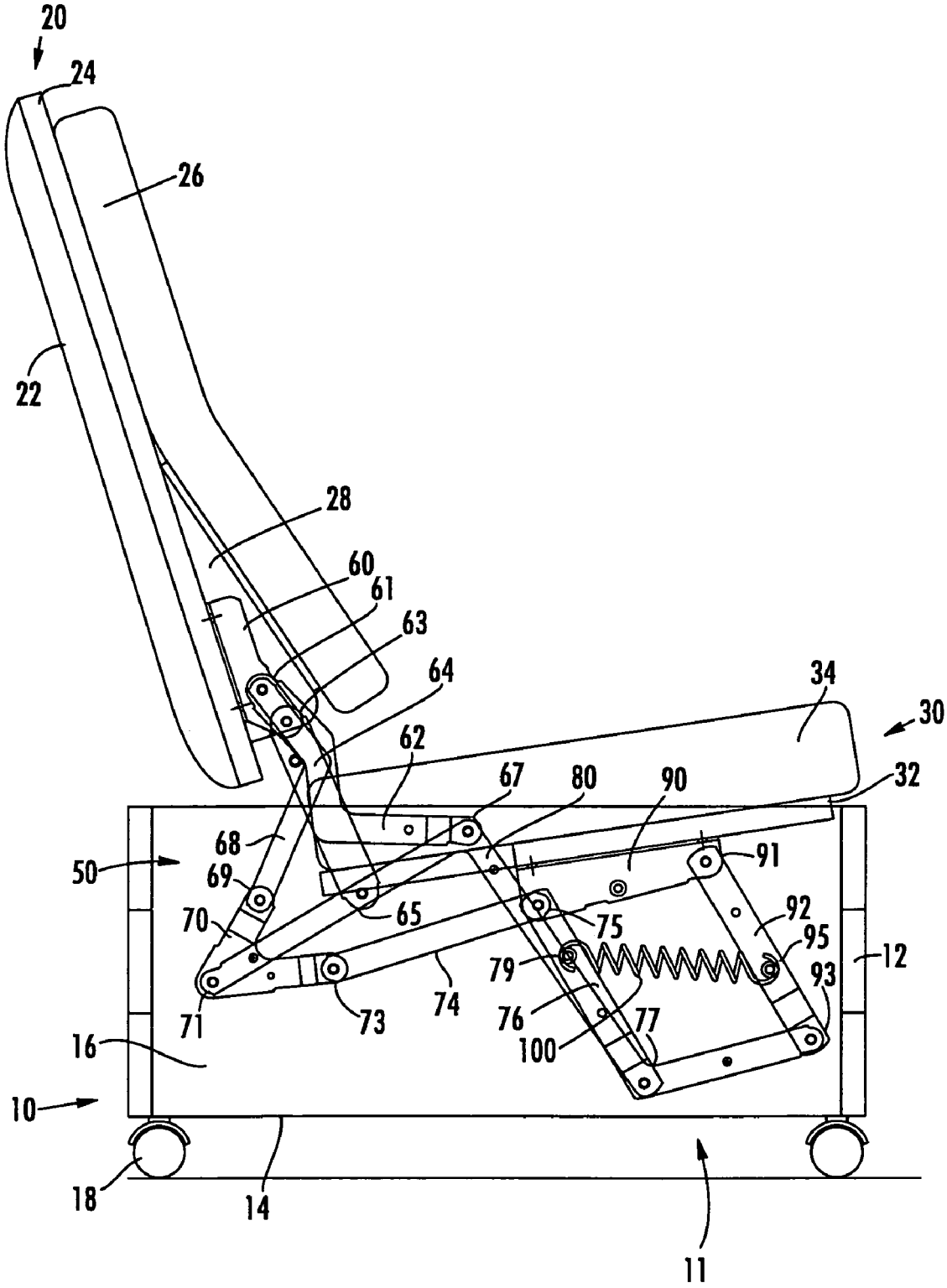
FIG. 2 is a side view of the ottoman of FIG. 1, wherein the ottoman is in its open position.

Referring now to the figures, a convertible ottoman, designated broadly at 10, is illustrated in FIGS. 1 and 2. The ottoman 10 includes a body 11 having sidewalls 12 and a floor 14. A lid 20 overlies the body 11. The body 11 houses a cavity 16 defined by the sidewalls 12, floor 14, and lid 20. A seat 30 and a pair of mechanisms 50 reside within the cavity 16. Although the body 11 is shown herein as being rectangular, those skilled in this art will recognize that other body shapes (such as round, square or oval) may also be used.

The lid 20 can be lifted to convert the ottoman 10 to a seating unit with a seat portion and a backrest. The movement of the seat 30 and lid 20 is controlled by a pair of mirror image mechanisms 50 (only one of which is shown herein), which comprise a plurality of pivotally interconnected members (typically links, brackets and the like). The mechanisms 50 are mirror images of each other about a longitudinally-extending vertical plane that bisects the ottoman 10 between the side walls 12; as such, the ensuing discussion will focus on only one of the mechanisms 50, with the discussion being equally applicable to the other mechanism 50 also. In this description, the position in which the lid 20 overlies the body 11, the underside of the lid 20 faces forward, and the seat 30 is beneath the lid 20, as shown in FIG. 1, is referred to as the closed position. The position in which the lid 20 is generally upright and located above a rear portion of the seat 30, the underside of the lid 20 faces generally forwardly and forms the backrest of a chair, and the seat 30 is accessible for a seated occupant, as shown in FIG. 2, is referred to as the open position.

The mechanism 50 is attached to the lid 20 via lid bracket 60, to the seat 30 via seat bracket 90, and to the sidewalls 12 via control bracket 80. While in the closed position of FIG. 1, lid bracket 60 is in a generally horizontal orientation, and seat bracket 90 is pitched slightly upward at an angle of 5–20 degrees from horizontal. The control bracket 80, which maintains its position relative to the sidewalls 12 throughout opening and closing, describes a circuitous path: from its rearmost end 71, it extends upward at an angle of 25–35 degrees to vertex 67. From there, control bracket 80 veers downward at 60–75 degrees until reaching its nadir at vertex 77, at which point it again extends upward at 15–30 degrees to its forwardmost end 93.

The seat bracket 90 is attached to the control bracket 80 via two links: a front swing link 92 and a rear swing link 76. The front swing link 92 is a generally straight link that, in the closed position of FIG. 1, is oriented slightly downward as it runs from seat bracket 90 at pivot 91 to control bracket 80 at pivot 93. The rear swing link 76 is a generally straight link that, in the closed position of FIG. 1, is also oriented slightly downward as it runs from seat bracket 90 at pivot 75 to control bracket 80 at pivot 77. The front swing link 92 and the rear swing link 76 are additionally connected by a spring 100. The spring 100 is more fully described hereinbelow.

The seat bracket 90 is driven by the lid bracket 60 via three links: a driving link 68, a fulcrum link 70, and a connecting link 74. The driving link 68 is a boomerang-shaped link that, in the closed position of FIG. 1, is oriented steeply downward as it runs from the seat bracket 60 at pivot 61 to the fulcrum link 70 at pivot 69. The fulcrum link 70 is an inverted V-shaped link, the vertex of which is pivotally interconnected with control bracket 80 at pivot 71 and the ends of which are pivotally interconnected to the driving link 68 at pivot 69 and the connecting link 74 at pivot 73. The connecting link 74 is a generally straight link that, in the closed position of FIG. 1, is oriented slightly upward as it runs from the fulcrum link 70 at pivot 73 to the seat bracket 90 at pivot 75.

The path during opening and closing of lid bracket 60 is dictated by its attachment to the control bracket 80 via two links: a bracing link 64 and a guiding link 62. The bracing link 64 is a generally straight link that, in the closed position of FIG. 1, is oriented slightly downward as it runs from the lid bracket 60 at pivot 63 to the control bracket 80 at pivot 65. The guiding link 62 is a tripartite link that, in the closed position of FIG. 1, angles first slightly downward, then more steeply downward and finally upward as it runs from its pivotal interconnection with lid bracket 60 at pivot 61 to its pivotal interconnection with control bracket 80 at pivot 67.

To move the lid 20 from the closed position of FIG. 1 to the open position of FIG. 2, an upward force is applied to the forwardmost end of lid 20. This force induces lid bracket 60 to pivot upward and rearward about pivots 61, 63. Specifically, pivot 63 moves upward and forward, as guided by the rotation of bracing link 64 about its pivotal interconnection with control bracket 80 at pivot 65. Pivot 61 moves upward and forward, as guided by the rotation of guiding link 62 about its pivotal interconnection with control bracket 80 at pivot 67. Driving link 68 also shares pivot 61 with guiding link 62 and lid bracket 60. As a consequence, lid bracket 60 draws pivot 61 of driving link 68 along its upward and forward path as well.

In turn, driving link 68, pivotally interconnected with fulcrum link 70 at pivot 69, pulls fulcrum link 70 upward at pivot 69. By virtue of the shape of fulcrum link 70 and its pivotal interconnection with control bracket 80 at pivot 71, the upward movement of pivot 69 causes fulcrum link 70 to push connecting link 74 forward. As a result, pivot 75, which the connecting link 74 shares with seat bracket 90 and rear swing link 76, is pushed forward and upward, as guided by the rotation of rear swing link 76 about its pivotal interconnection with control bracket 80 at pivot 77. The motion of seat bracket 90 is further controlled by front swing link 92, with which seat bracket 90 is pivotally interconnected at pivot 91. Front swing link 92 ensures that the forwardmost end of seat bracket 90 moves upward and forward, along the rotation of front swing link 92 about its pivotal interconnection with control bracket 80 at pivot 93.

The end result of this configuration of links and brackets is that when an upward force is applied to lid 20, the lid 20 rotates upward and rearward and the seat 30 is displaced upward and forward (i.e., from a lowered position to a raised position).

In order to enhance stability during the opening and closing of the ottoman 10, spring 100 provides resistance while the ottoman 10 is being closed and assists opening of the ottoman 10. The spring 100 accomplishes this through its connection to front swing link 92 at connection 95 and to rear swing link 76 at connection 79. In the closed position of FIG. 1, spring 100 is in tension, so that it can assist in the opening of the ottoman 10. As the ottoman 10 opens, connections 95 and 79 move closer to each other and the spring 100 therefore contracts until, when the ottoman 10 is in the open position of FIG. 2, the spring 100 is largely relaxed. As such, when a user closes the ottoman 10, the motion is resisted.

One feature for the comfort of the user is that when the convertible ottoman 10 is in the open position, both the seat 30 and the lid 20 are pitched, or inclined, in their angular orientation relative to the surface underling the ottoman 10. That is, in the open position of FIG. 2, the forwardmost end of the seat 30 is disposed in a more upward position relative to the rear end of seat 30, and the upper end of lid 20 is disposed in a more rearward position relative to the lower end of lid 20. In the open position, the lid 20 may be disposed at an angle of between about 60 and 85 degrees relative to the underlying surface, and the seat 30 may be inclined at an angle of between about 1 and 15 degrees relative to the underlying surface.

The lid 20 comprises top cushion 22, rigid lid board 24, backrest cushion 26, and lumbar support 28. Top cushion 22 or other upholstery is disposed along the upper portion of lid 20 so that when the ottoman 10 is in the closed position, top cushion 22 provides comfort to the user, who may use the ottoman 10 as either a stool-type seat or a footrest. Rigid lid board 24 provides structure and rigidity. Backrest cushion 26 or other upholstery is disposed along the underside of lid 20, so that when the ottoman 10 is in the open position, backrest cushion 26 provides comfort to the user as a padded backrest. An optional lumbar support 28 can support the lower regions of a seated user's back due to its being canted relative to the remaining face of the backrest cushion 26.

The seat 30 includes a rigid seat board 32, which provides structural integrity, and seat cushion 34, which is disposed along the upper portion of seat 30. Thus, when the ottoman 10 is in the open position, seat cushion 34 provides a padded seating area to the user.

The ottoman 10 additionally includes castors 18, which allow the ottoman 10 to be rolled along an underlying surface. The castors 18 can be locked into their position, so that the ottoman 10 can be stabilized and fixed relative to the underlying surface. Whether castors are present or not, in some embodiments the rearward edge of the seat 30 may be between 8 and 14 inches from the underlying surface in order to provide an occupant with a comfortable seating height.

The foregoing demonstrates that the ottoman 10 can provide a footrest when the lid 20 is in the closed position and a comfortable seating unit when the lid 20 is in the open position. The coupling of the lid 20 and seat 30 via the mechanisms 50 enables both of these components to travel to positions that provide a comfortable seating unit for a seated occupant.

Though not shown in the figures, the ottoman 10 may also include storage trays and stowing receptacles. Such storage trays can be disposed proximate to the lid 20, such that when the ottoman 10 is in the open position, the seated user has the storage tray at his side. The storage trays may be configured to accommodate the size and shape of gaming devices. Stowing receptacles may also reside in the cavity 16 under the seat 30. One way to provide access to the stowing receptacle, for example, is to configure the seat 30 to be movable when the ottoman 10 is in the open position.

Figure 3:
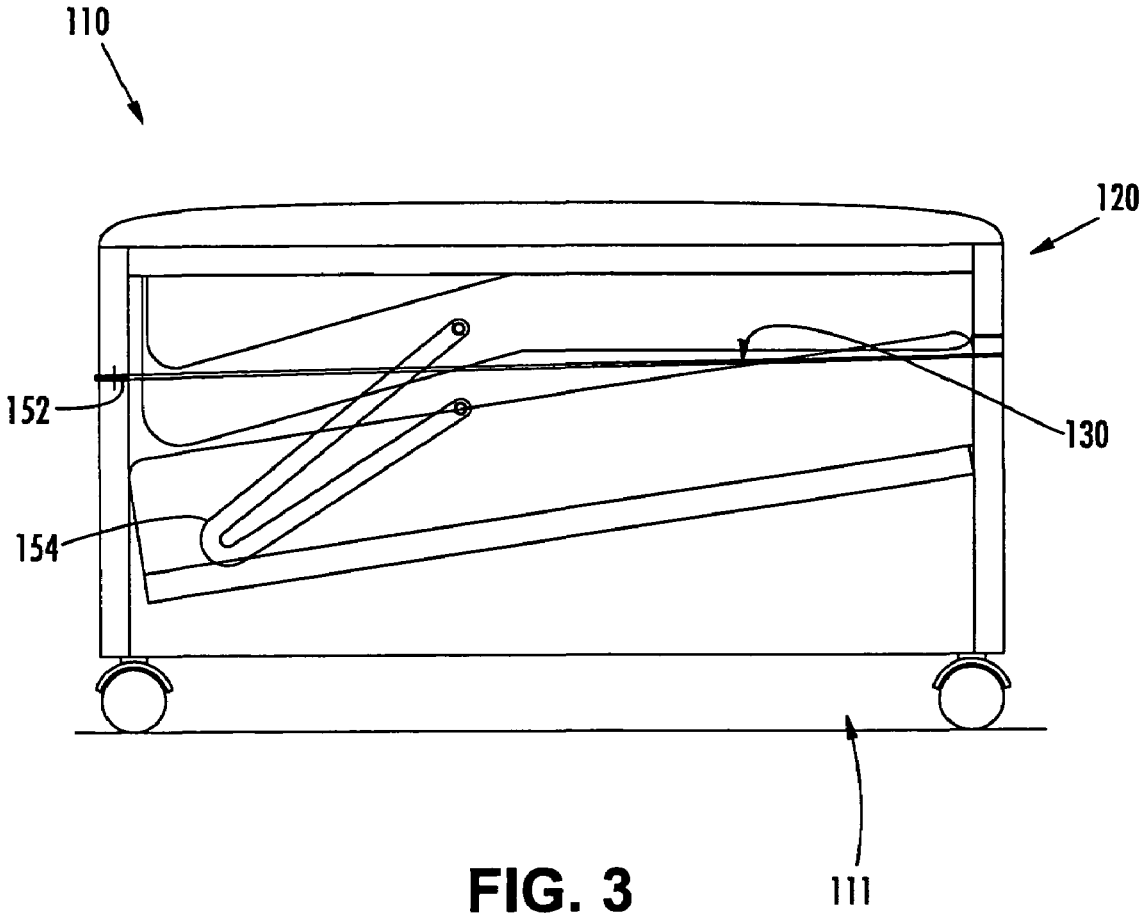
FIG. 3 is a side view of an ottoman according to other embodiments of the present invention, wherein the ottoman is in its closed position.
Figure 4:
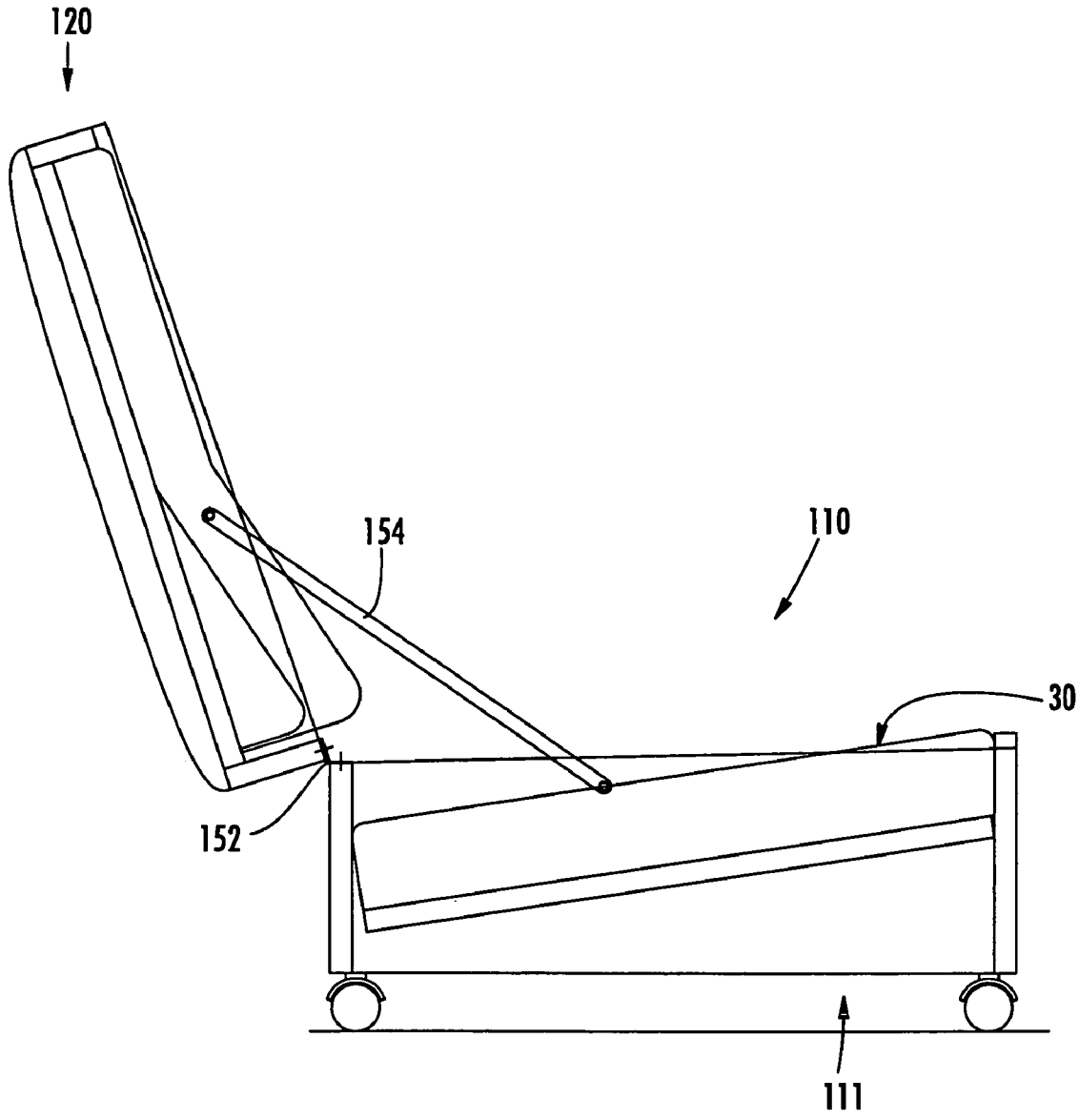
FIG. 4 is a side view of the ottoman of FIG. 3, wherein the ottoman is in its open position.

Other embodiments of the present invention are shown in FIGS. 3 and 4. FIG. 3 is a side view of the ottoman 110 in the closed position, and FIG. 4 is a side view of the ottoman 110 in the open position. In these embodiments, the opening of lid 120 is governed by the hinged connection 152 and flexible strap 154. The hinged connection 152 connects lid 120 with the body 111 of ottoman 110. Strap 154 connects lid 120 to body 111 and therefore controls the degree to which the lid 120 is allowed to rotate rearward. Significantly, the embodiments illustrated in FIGS. 3 and 4 provide many of the features of the embodiments described hereinabove with reference to FIGS. 1 and 2, including a seat 130 (the top surface of the body 111) and lid 120 that are pitched in their angular position.

Those skilled in this art will appreciate that variations to the embodiments shown may also be employed with furniture pieces of the present invention. For example, the seat may remain stationary in some embodiments (such as that of FIGS. 3 and 4), and even if the seat is movable it may be decoupled from the lid. In some embodiments the seat and/or backrest may not be inclined or pitched. In addition, other furniture pieces, such as cabinets, chests or the like, may also be configured to include a lid and seat similar that those illustrated and described herein.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. The invention is defined by the following claims.

That which is claimed is:

1. An ottoman convertible to a seating unit, comprising:

a body having a cavity;

a seat pivotally interconnected with the body via a mechanism comprising a plurality of pivotally interconnected links, the mechanism being configured such that the seat is movable between a lowered position and a raised position; and a lid pivotally attached to the body, the lid having an underside;

wherein the lid is movable between a closed position, in which the lid overlies the body, the seat is beneath the lid and resides in the cavity, and the underside of the lid faces generally downwardly, and an open position, in which the lid is generally upright and located above a rear portion of the body, the underside of the lid faces generally forwardly and forms the backrest of a seating unit and the seat is accessible for a seated occupant; and wherein the seat is inclined from rear to front; and wherein the mechanism includes a biasing member that biases the seat toward the raised position.

2. The ottoman defined in claim 1, wherein an upper side of the lid opposite the underside is upholstered.

3. The ottoman defined in claim 1, further comprising castors mounted to the body for supporting the body from underneath and permitting rolling motion of the body on an underlying surface.

4. The ottoman defined in claim 1, wherein the mechanism is connected to the lid and thereby couples the lid and the seat such that movement of the lid to the open position moves the seat to the raised position.

5. The ottoman defined in claim 1, wherein the mechanism includes front and rear swing links, each of which is pivotally interconnected with the body and with the seat.

6. The ottoman defined in claim 5, wherein the biasing member comprises a spring extending between the front and rear swing links that biases the seat toward the raised position.

7. The ottoman defined in claim 1, wherein the lid is pivotally interconnected with the body via a mechanism comprising a plurality of interconnected links.

8. The ottoman defined in claim 1, further comprising a flexible strap extending between the body and the lid, the strap becoming taut as the lid moves to the open position.

9. The ottoman defined in claim 1, wherein the underside of the lid comprises two faces that are canted relative to each other.

10. The ottoman defined in claim 1, wherein the seat is inclined at an angle of between about 1 and 15 degrees to the underlying surface when the lid is in the open position.

11. The ottoman defined in claim 1, wherein the lid is inclined at an angle of between about 60 and 85 degrees to the underlying surface when the lid is in the open position.

12. An ottoman convertible to a seating unit, comprising:

a body;

a seat;

a mechanism comprising a plurality of pivotally interconnected members, the mechanism coupling the seat with the body; and a lid pivotally attached to the body, the lid having an underside;

wherein the lid is movable between a closed position, in which the lid overlies the body, the seat is beneath the lid, and the underside of the lid faces generally downwardly, and an open position, in which the lid is generally upright and located above a rear portion of the body, the underside of the lid faces generally forwardly and forms the backrest of a seating unit and the seat is accessible for a seated occupant; and wherein the mechanism is configured such that the seat can move between a lowered position and a raised position; and wherein the mechanism includes front and rear swing links, each of which is pivotally interconnected with the body and with the seat, the mechanism further comprising a spring extending between the front and rear swing links that biases the seat toward the raised position.

13. The ottoman defined in claim 12, wherein the mechanism is pivotally attached to the lid, such that movement of the lid to the open position also induces movement of the seat to the raised position.

14. The ottoman defined in claim 12, wherein the body includes a cavity, and wherein the seat resides in the cavity when the seat is in the lowered position.

15. The ottoman defined in claim 12, wherein an upper side of the lid opposite the underside is upholstered.

16. The ottoman defined in claim 12, further comprising castors mounted to the body for supporting the body from underneath and permitting rolling motion of the body on an underlying surface.

17. The ottoman defined in claim 12, wherein the mechanism includes a biasing member that biases the seat toward the raised position.

18. The ottoman defined in claim 12, wherein the underside of the lid comprises two faces that are canted relative to each other.

19. The ottoman defined in claim 12, wherein the seat is inclined at an angle of between about 1 and 15 degrees to the underlying surface when the lid is in the open position.

20. The ottoman defined in claim 12, wherein the lid is inclined at an angle of between about 60 and 85 degrees to the underlying surface when the lid is in the open position.

21. An ottoman convertible to a seating unit, comprising:

a body;

a seat;

a mechanism comprising a plurality of pivotally interconnected members, the mechanism coupling the seat with the body; and a lid pivotally attached to the body, the lid having an underside;

wherein the lid is movable between a closed position, in which the lid overlies the body, the seat is beneath the lid, and the underside of the lid faces generally downwardly, and an open position, in which the lid is generally upright and located above a rear portion of the body, the underside of the lid faces generally forwardly and forms the backrest of a seating unit and the seat is accessible for a seated occupant; and wherein the mechanism is configured such that the seat can move between a lowered position and a raised position; and wherein the mechanism includes front and rear swing links, each of which is pivotally interconnected with the body and with the seat.

22. An ottoman convertible to a seating unit, comprising:

a body;

a seat;

a mechanism comprising a plurality of pivotally interconnected members, the mechanism coupling the seat with the body; and a lid pivotally attached to the body via the mechanism, the lid having an underside;

wherein the lid is movable between a closed position, in which the lid overlies the body, the seat is beneath the lid, and the underside of the lid faces generally downwardly, and an open position, in which the lid is generally upright and located above and spaced apart from a rear portion of the body, the underside of the lid faces generally forwardly and forms the backrest of a seating unit and the seat is accessible for a seated occupant; and wherein the mechanism is configured such that the seat can move between a lowered position and a raised position, and wherein the front end of the seat and the rear end of the seat rise in moving from the lowered position to the raised position.

* * * * *